US005433869A

United States Patent [19]

Harmalker et al.

[11] Patent Number: 5,433,869

[45] Date of Patent: Jul. 18, 1995

[54] LIQUID FABRIC CONDITIONING COMPOSITION CONTAINING AMIDOAMINE SOFTENING COMPOUND

[75] Inventors: Subhash Harmalker, Somerset, N.J.; Jean-Paul Grandmaire, Andrimont, Belgium

[73] Assignee: Colgate-Palmolive Co., New York, N.Y.

[21] Appl. No.: 40,063

[22] Filed: Mar. 30, 1993

Related U.S. Application Data

[63] Continuation-in-part of Ser. No. 994,847, Dec. 22, 1992, abandoned.

[51] Int. Cl.[6] ..... D06M 13/402; D06M 13/419

[52] U.S. Cl. ..... 252/8.8; 252/8.6; 252/8.9; 8/188

[58] Field of Search ..... 252/8.6, 8.8, 8.9; 8/188

[56] References Cited

U.S. PATENT DOCUMENTS

| | | | |
|---|---|---|---|
| 3,904,359 | 9/1975 | Ramachandran | 8/137 |
| 3,954,630 | 5/1976 | Ramachandran | 252/8.6 |
| 5,128,055 | 7/1992 | Foster | 252/8.9 |
| 5,133,885 | 7/1992 | Contur et al. | 252/8.6 |
| 5,154,838 | 10/1992 | Yamamura et al. | 252/8.6 |
| 5,180,508 | 1/1993 | Birkham et al. | 252/8.8 |
| 5,242,607 | 9/1993 | Yamamura et al. | 252/8.6 |
| 5,282,983 | 2/1994 | Yamamura et al. | 252/8.6 |
| 5,288,847 | 2/1994 | Harmalker et al. | 252/8.8 |

FOREIGN PATENT DOCUMENTS

| | | |
|---|---|---|
| 913309 | 10/1972 | Canada . |
| 052517 | 5/1982 | European Pat. Off. . |
| 459211 | 6/1990 | European Pat. Off. . |
| 534009 | 3/1993 | European Pat. Off. . |
| 143396 | 6/1988 | Japan . |
| 2173827 | 3/1986 | United Kingdom . |

*Primary Examiner*—Paul Lieberman
*Assistant Examiner*—Michael P. Tierney
*Attorney, Agent, or Firm*—Bernard Lieberman; Robert C. Sullivan

[57] ABSTRACT

This invention relates to fabric conditioning compositions containing inorganic acid salts of defined amidoamine compounds in combination with a carboxylic acid, which compositions are characterized by superior environmental compatibility relative to conventional quaternary ammonium fabric softening compositions concomitant with providing improved calcium salt solubilization and reduction of encrustation on treated fabrics.

14 Claims, No Drawings

LIQUID FABRIC CONDITIONING COMPOSITION CONTAINING AMIDOAMINE SOFTENING COMPOUND

This application is a continuation-in-part of U.S. Ser. No. 07/994,847 filed Dec. 22, 1992 now abandoned, the disclosure of which is incorporated herein by reference.

FIELD OF INVENTION

This invention is related to copending U.S. application (I.R. 5121) filed on even date herewith which describes liquid fabric softening compounds containing amidoamine softening compounds in combination with a diapersant or stabilizer for said softening compound.

This invention relates to fabric conditioning compositions which are suitable for softening in the rinse cycle of an automatic household washing machine and which are especially adapted for use under European laundering conditions. More particularly, the invention relates to fabric conditioning compositions containing defined amidoamine compounds and their inorganic acid salts in combination with a carboxylic acid, which compositions are characterized by superior environmental compatibility relative to conventional quaternary ammonium fabric softening compositions concomitant with providing improved calcium salt solubilization and reduction of encrustation on treated fabrics.

BACKGROUND OF THE INVENTION

Liquid amidoamine softeners have been described in the prior art. U.S. Pat. No. 5,154,838 (corresponding to EP 0459211A2) to Yamamura, et al. (assigned to Kao Corp.) discloses an aqueous liquid softener composition based on an amidoamine compound which is the condensation reaction product of a di- or tri-amine of formula (I)

$$R^1NH(C_mH_{2m}NH)_nH \qquad (I)$$

with a fatty acid of formula (II)

$$R^2\underset{\underset{O}{\|}}{C}-OH \qquad (II)$$

wherein $R^1$ represents a straight or branched chain, saturated or unsaturated hydrocarbon group having 8 to 24 carbon atoms, $R^2$ represents a straight or branched, saturated or unsaturated hydrocarbon group having 7 to 23 carbon atoms, m represents 2 or 3, and n is 1 or 2. These compounds, which are neither hydroxylated or ethoxylated, are noted to have high dispersibility in rinse water, especially when the amidoamine compound is used in the form of its neutral salt.

In U.S. Pat. No. 5,133,885 to L. Contor, et al. (assigned to Colgate-Palmolive Co., the assignee of the present invention) fabric softening compositions are described which are aqueous dispersions of a fatty acid ester quat of formula

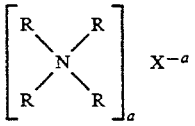

where one or two R groups represent an aliphatic ester residue of from 12 to 30 carbon atoms of formula $CH_{2n}OCOR_4$, and the remaining R groups represent lower aliphatic, aralkyl or hydroxyalkyl groups, $X^-$ is an anion and "a" represents the ionic valence of the anion, and a fatty acid amidoamine softener of formula $$R^1CONH(CH_2)_mN(R^2)-R^3$$

where $R^1$ is a $C_{12}$ to $C_{30}$ alkyl or alkenyl group, $R^2$ represents $RT^1$,$R^1CONH(CH_2)_m$ or $CH_2CH_2OH$; $R^3$ represents hydrogen, methyl, or $(CH_2CH_2O)_pH$, m is a number of 1 to 5 and p is a number of 1 to 5, at a weight ratio of ester quat to amidoamine of from 10:1 to 1:10.

The combination of organic acid with cationic fabric softener such as amines and quaternary ammonium compounds is extensively disclosed in the prior art. U.S. Pat. Nos. 3,904,359 and 3,954,630 to Ramachandran disclose a fabric treating composition comprising a complexing acid such as citric or maleic acid in combination with a quaternary ammonium compound or amines such as primary tallow and primary coco amine. The function of the acid, as stated in the patents, is to prevent yellowing of fabrics due to build-up of cationic softener and to provide a complexing site for metal ions contained in soils. U.S. Pat. Nos. 4,828,722 to Steltenkamp and U.S. 4,869,836 to Harmalker disclose multicarboxylic acid complexes of tertiary amines formed from a tertiary amine and a carboxylic acid selected from among citric acid and di and tri carboxylic acids having 21 to 54 carbon atoms. In U.S. Pat. No. 4,828,856 there is disclosed a fabric softener composition comprising a combination of carboxylic acid and amines having a long chain alkyl or alkenyl radical.

Although satisfactory results may be obtained with one or more of these prior art fabric softening compositions, further improvements are needed in terms of being able to provide efficacious fabric softening with a biodegradable cationic fabric softening compound, concomitant with the ability to substantially solubilize and remove mineral encrustation from the fabrics to be treated. This is a particularly important need for European fabric conditioning compositions where the cumulative deposition of mineral salts on fabrics during repetitive laundering in hard water is an acute problem. Moreover, the increased emphasis in Europe on using biodegradable softening compounds which have no toxic effect on aquatic organisms in aqueous effluent streams makes it imperative that conventional softening compounds, most notably, the di-long chain, di-short chain quaternary ammonium compounds be replaced as the softening compounds of choice in commercial rinse-cycle softening compositions with softening compounds which are significantly more compatible with environmental concerns.

SUMMARY OF THE INVENTION

The present invention provides a stable, aqueous, pourable and water dispersible fabric conditioning composition which is biodegradable and capable of providing softening concomitant with significant reduction and solubilization of unwanted mineral encrustations on fabrics to be conditioned, such encrustations having been generally deposited on the fabrics during the course of prior laundering in water having a high mineral content, which conditioning composition comprises:

(a) a mixture of:

(i) a fabric softening effective amount of an inorganic acid salt of a finely divided fabric softening compound formula (I):

$$R_1-CONH(CH_2)_nN(R_2)-R_3 \quad (I)$$

wherein $R_1=C_{12}$ to $C_{30}$ alkyl or alkenyl,
$R_2=R_1CONH(CH_2)_m$,
n=1 to 5,
m=1 to 5,
p=1 to 10; and (ii) unreacted inorganic acid, wherein said inorganic acid salt is formed by the reaction of said fabric softening compound with an inorganic acid in a mole ratio of inorganic acid to fabric softening compound of from about 0.5:1 to about 5:1, the amount of acid being sufficient to prevent the fabric conditioning composition from forming a gelled structure, but less than an amount which adversely affects the physical stability of said fabric conditioning composition; and (b) A $C_2$-$C_6$ carboxylic acid in an amount effective for removing encrustation from the fabrics to be conditioned;

(c) an aqueous solvent.

In a preferred embodiment of the invention, the amido amine fabric softening compounds of formula I are defined wherein $R_1=C_{16}$ to $C_{22}$ alkyl,
$R_2=R_1CONH(CH_2)_n$, n=1 to 3,
$R_3=(CH_2CH_2O)_pH$, and p=1.5 to 3.5

An especially preferred composition according to the invention is one wherein the fabric softening compound of formula I is bis(hydrogenated tallow amidoethyl)-2-hydroxyethyl amine.

The amount of fabric softening compound in the fabric conditioning composition is generally from about 1 to 25%, depending on whether the composition is intended for direct use in the rinse cycle of an automatic washing machine, or whether the composition is prepared in concentrated form which may be diluted with water prior to use, or alternatively may be used directly at reduced levels.

For direct use of a conditioning composition in the conventional rinse cycle dosage of about 110 ml in a European washing machine, the effective amount of softening compound is preferably about 2 to about 8%, by weight, of the composition.

The inorganic acid used to react with the fabric softening compound to form the salt of the compound is generally hydrochloric acid, although any strong mineral acid may be used to protonate the amidoamine softening compound, such as, nitric acid, phosphoric acid and phosphonic acid. Generally, the amount of carboxylic acid is from about 1 to 25% by weight of the composition.

The compositions may advantageously contain from 0% to about 5%, by weight, of a lower alkanol of from 2 to 4 carbon atoms, such as isopropanol.

The invention also encompasses a method for softening fabrics and removing unwanted mineral encrustations therefrom comprising rinsing the fabrics to be treated in an aqueous bath containing an effective amount of a composition comprised of the above-defined mixture.

The present invention is predicated on the discovery that a stable, pourable liquid fabric conditioning composition which is efficacious in hard water, i.e. European laundering conditions, as in soft water, can be prepared with an amidoamine ethoxylate compound as defined herein without the need for a stabilizer or dispersant such as those disclosed in the copending application (IR 5121) identified in the first paragraph herein, by first forming the inorganic acid salt of the softening compound by the reaction of an amidoamine ethoxylate softening compound, for example, with an inorganic acid such as HCl whereby the amount of inorganic acid is within the defined mole ratio of acid to softening compound of from about 0.5:1 to about 5:1, preferably about 0.5:1 to about 3:1, and further, the amount of acid is sufficient to prevent the composition from gelling, yet is less than an amount which would otherwise destabilize the composition and cause product separation. Within the defined mole ratios specified above, the optimum amount of acid is readily ascertained by simple trial and error technique. For the preferred amidoamine ethoxylates which are comprised of bis(hydrogenated tallow amidoethyl)-2-hydroxyethyl amine, the mole ratio of inorganic acid to amidoamine compound is most preferably from about 0.5:1 to 2:1.

The present invention is also based on the discovery that the further addition of a carboxylic acid as herein described to the inorganic acid salt of the amidoamine softening compound stabilizes the mixture of inorganic acid salt and unreacted acid so as to provide effective softening under soft water as well as hard water laundering conditions and provides a biodegradable liquid softener which has the capability of removing mineral encrustations, such as calcium and magnesium salts, and in particular, phosphates and carbonates of calcium and magnesium, which cumulatively deposit on the fabrics during the course of prior laundering in hard water, i.e. water having a mineral content about 300 ppm, conditions generally associated with European laundering conditions.

The compositions of the invention may include minor amounts of usual additives such as perfume, coloring agents, preservatives and the like. These compositions will have acidic pH's in the range of from about 1.5 to 4.

In an alternate embodiment of the invention, the fabric conditioning composition is not initially reacted with an inorganic acid to form the salt thereof, but rather, an organic acid such as citric acid is added to water and the amidoamine softening compound to form an aqueous mixture, which aqueous mixture is then agitated under turbulent conditions using a high pressure homogenizer to form a homogenized mixture having particle sizes of from about 0.2 to 2 microns. The effect of such homogenization is to substantially retard the small homogenized particles from flocculating and forming unwanted large aggregates having particle sizes above, for example, 10 microns which would have an adverse affect on softening as well as stability. For purposes of the invention, a Manton Gaulin homogenizer is preferred.

Following homogenization, the temperature of the mixture is generally about 65° to 70° C., above the melting point of the amidoamine compound (which is about 45° C.). To prevent agglomeration of the finely divided particles which may result in product separation and instability, the mixture is rapidly cooled by heat exchange to below 45° C. in a period of about 1 to 5 minutes. The term "rapidly cooling" as used herein refers to cooling by conductance or heat exchange to lower the temperature of the mixture more rapidly than can be achieved simply by radiation to the ambient.

DETAILED DESCRIPTION AND PREFERRED EMBODIMENTS

The present invention was developed based on an extensive research program to evaluate available fabric softening compounds which do not pose the risk of, or at least reduce the risk of, causing environmental damage associated with conventional cationic quat fabric softeners such as dimethyl distearyl ammonium chloride ("DMDSAC") yet which offer equivalent or superior softening performance to DMDSAC and which are amenable for use in concentrated products. The latter requirement is important in view of the trend in the industry to sell concentrated products which require less packaging and lower shipping costs on a per unit or per usage basis and, therefore, can be characterized as environmentally and user friendly.

As a result of this extensive research it was found that the class of amidoamines, and particularly fatty amido-tertiary amines of the foregoing formula (I), which are included in the definition of the amidoamine compounds disclosed in the aforementioned U.S. Pat. No. 5,133,885, and which are commercially available, for example, under the Varisoft trademark from Sherex Chemical Co., when provided in the form of its acid (protonated) complex, met the objectives of high efficacy softening performance and environmental acceptability.

Although not wishing to be bound by any particular theory of operation it is believed that the good softening performance is due to the excellent inherent dispersibility of the finely divided amidoamine softener when the compound is protonated as its acid complex. Such excellent inherent dispersibility is believed to result from the presence of the diamido amine hydrophilic group, which may be further enhanced by a moderate level of ethoxylation (e.g., when $R_3$ represents $(CH_2CH_2O)_pH$). On the other hand, the presence of the two long chain hydrocarbon groups ($C_8$–$C_{20}$ alkyl or alkenyl) contribute to effective fabric softening.

However, the performance of the fatty amido tertiary amine fabric softeners of formula (I) was found to be less effective in hard water than in soft water. It is presumed that this poorer performance may result from the hardness ions in the rinse water causing agglomeration of the fabric softener particles or otherwise inhibiting deposition of the fabric softener on the fabric being treated. Moreover, improvements in storage stability, as measured by absence of phase separation under a wide range of temperature conditions, were desired.

While it has been known in the past that stability against phase separation of aqueous dispersions of finely divided substances, including fabric softening or other fabric treating agents, may be improved by incorporating certain dispersing aides, co-surfactants, emulsifiers, and the like, into the aqueous dispersions, the art has not provided any general guidelines or principles for determining which of the myriad possible candidate compounds would be able to provide the desired improvement in stability, much less improvement in softening performance, especially in hard water, and not only for ready-to-use products, but also for concentrated products.

The fabric softening active compound is an amidoamine of formula (I):

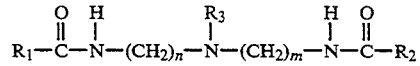

(I)

In the above formula $R_1$ and $R_2$ are each, independently, long chain alkyl or alkenyl groups having from 8 to 22 carbon atoms, preferably from 10 to 18 carbon atoms, such as, for example, octyl, octenyl, decyl, decenyl, dodecyl, dodecenyl, octadecyl, octadecenyl. Typically, $R_1$ and $R_2$, and more generally $R_1$—CO— and $R_2$—CO, will be derived from natural oils containing fatty acids or fatty acid mixtures, such as coconut oil, palm oil, tallow, rape oil, and fish oil. Chemically synthesized fatty acids are also usable. The saturated fatty acids or fatty acid mixtures, and especially hydrogenated tallow (H-tallow) acid (also referred to as hard tallow), are preferred. Generally and preferably $R_1$ and $R_2$ are derived from the same fatty acid or fatty acid mixture.

$R_3$ represents $(CH_2CH_2O)pH$, $CH_3$ or H, or mixtures thereof may also be present. When $R_3$ represents the preferred $(CH_2CH_2O)_pH$ group, p is a positive number representing the average degree of ethoxylation, and is preferably from 1 to 10, especially 1.5 to 6, and most preferably from about 2 to 4, such as 2.5. n and m are each integers of from 1 to 5, preferably 2 to 4, especially 2. The compounds of formula (I) in which $R_3$ represents the preferred $(CH_2CH_2O)_pH$ group are broadly referred to herein as ethoxylated amidoamines, and the term "hydroxyethyl" is also used to describe the $(CH_2CH_2O)_pH$ group.

Most especially preferred is the compound of formula (I) which is commercially available under the tradename Varisoft 510, available from Sherex Chemical Company, which is bis(hydrogenated tallow-amidoethyl)-hydroxyethyl amine of formula

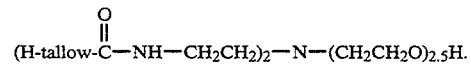

EXAMPLE I

In accordance with one aspect of the invention the following fabric conditioning composition was prepared:

| COMPOSITION | WEIGHT PERCENT |
|---|---|
| [Bis (Hydrogenated Tallow Amido Ethyl)-2-Hydroxy Ethyl Amine][1] | 5.00 |
| Isopropyl Alcohol | 2.00 |
| Deionized Water | 82.64 |
| Hydrochloric Acid (12M) | 0.36 |
| Citric Acid (Anhydrous) | 10.00 |
| | 100.00 |

[1]Varisoft 510 for Sherex Company

The above-described composition was prepared by first melting the Varisoft 510 in the presence of isopropyl alcohol. Hydrochloric acid was separately mixed with deionized water, heated to 70° C. and then added to the melted Varisoft 510 while mixing at 200 rpm. Citric acid was then added to the mixture under agitation. It is imperative to disperse the Varisoft 510 with the hydrochloric acid before mixing with the citric acid in order to prevent the unwanted formation of an emulsion having unduly large particle sizes which adversely affect softening as well as product physical stability.

EXAMPLE 2

In accordance with a second aspect of the invention, the following fabric conditioning composition was prepared:

| COMPOSITION | WEIGHT PERCENT |
|---|---|
| [Bis (Hydrogenated Tallow Amido Ethyl)-2-Hydroxy Ethyl Amine][1] | 3.75 |
| Polyacrylate[2] | 0.9 |
| Perfume | 0.32 |
| Citric Acid (Anhyrous) | 10. |
| Deionized Water | Balance |

[1]Rewopal V 2762 From Rewo Company
[2]Acrysol DW 1206 from Rohm and Haas

The above-described composition was prepared by adding citric acid to water at 70° C. and then forming an aqueous mixture with the addition of the amidoamine ethoxylate compound and perfume. The resulting mixture was then homogenized in a Manton Gaulin high pressure homogenizer to form a mixture having particle size diameters from about 0.2 to 2 microns. The temperature of the mixture was about 70° C. The homogenized mixture was then rapidly cooled to below the amidoamine melting point (i.e. below about 45° C.) in order to stabilize the particle size and prevent unwanted particle agglomeration.

The conditioning composition described above was used as a rinse cycle softener in a European Miehle washing machine to soften new as well as hardened towels. Effective softening and encrustation prevention on the towels was achieved.

We claim:

1. A stable, aqueous, pourable and water dispersible fabric conditioning composition which is biodegradable and capable of providing fabric softening concomitant with significant reduction and solubilization of unwanted mineral encrustations on fabrics to be conditioned, such encrustations having been generally deposited on the fabrics during the course of prior laundering in water having a high mineral content, which conditioning composition comprises, by weight, of (a) 1% to 25% of an acid complex of:

(i) as the sole softening component a fabric softening effective amount of a softening compound of formula (I):

$$R_1-CONH(CH_2)_nN(R_2)-R_3 \quad (I)$$

wherein R1 is C12 to C30 alkyl or alkenyl,
R2=R1CONH(CH2)m,
R3=(CH2CHO)pH, CH3 or H,
n=1 to 5,
m=1 to 5,
p=1 to 10; and (ii) unreacted inorganic acid, wherein said acid complex is formed by the reaction of said fabric softening compound with said inorganic acid in a mole ratio of inorganic acid to fabric softening compound of from about 0.5:1 to about 5:1, the amount of acid being sufficient to prevent the fabric conditioning composition from forming a gelled structure, but less than an amount which adversely affects the physical stability of said fabric conditioning composition;

(b) 1% to 25% of a C2–C6 carboxylic acid in an amount effective for removing encrustation from the fabrics to be conditioned; and (c) an aqueous solvent.

2. The fabric conditioning composition of claim 1 wherein said acid complex is an inorganic acid salt of bis(hydrogenated tallow amidoethyl)-2-hydroxyethyl amine having a mole ratio of inorganic acid to said compound of formula (I) of about 0.5:1 to 2:1 and is present in an amount of 2% to 8% by weight.

3. The fabric conditioning composition of claim 1 wherein in the compound of formula (I),
$R_1=C_{16}$ to $C_{22}$ alkyl,
R2=R1CONH(CH2)m, m=1 to 3
$R_3=(CH_2CH_2O)_pH$, and p=1.5 to 3.5.

4. The fabric conditioning composition of claim 1 wherein said inorganic acid is selected from the group consisting of hydrochloric acid, nitric acid, sulfuric acid, phosphoric acid and mixtures thereof.

5. The fabric conditioning composition of claim 4 wherein said inorganic acid is hydrochloric acid.

6. The fabric conditioning composition of claim 1 wherein said carboxylic acid is selected from the group consisting of citric acid, malonic acid, maleic acid, lactic acid, glycolic acid, and mixtures thereof.

7. The fabric conditioning composition of claim 6 wherein said carboxylic acid is citric acid.

8. The fabric conditioning composition of claim 1 wherein the aqueous solvent comprises water and from 0% to about 5%, based on the total composition, of a lower alkanol of from 2 to 4 carbon atoms.

9. A stable, aqueous, pourable and water dispersible fabric conditioning composition which is biodegradable and capable of providing fabric softening concomitant with significant reduction and solubilization of unwanted mineral encrustations on fabrics to be conditioned, such encrustations having been generally deposited on the fabrics during the course of prior laundering in water having a high mineral content, which conditioning composition comprises, by weight, a homogenized mixture of:

(a) 1% to 25% of a fabric softening compound of formula (I) as the sole softening component:

$$R_1-CONH(CH_2)_nN(R_2)-R_3 \quad (I)$$

wherein R1=C12 to C30 alkyl or alkenyl,
R2=R1CONH(CH2)m,
R3=(CH2CH2O)pH, CH3 or H,
n=1 to 5,
m=1 to 5, and
p=1 to 10;

(b) 1% to 25% of a C2–C6 organic acid; and (c) an aqueous solvent, said mixture being formed by admixing an aqueous mixture of said organic acid with said softening compound and agitating the resultant mixture under turbulent conditions using a high pressure homogenizer to form said homogenized mixture having a particle size of about 0.2 to 2 microns.

10. The fabric conditioning composition of claim 9 wherein in the compound of formula (I), $R_1 = C_{16}$ to $C_{22}$ alkyl, R2=R1CONH(CH2)m, m=1 to 3

$R_3 = (CH_2CH_2O)_pH$, and p=1.5 to 3.5.

11. The fabric conditioning composition of claim 9 wherein the softening compound of formula I comprises bis(hydrogenated tallow amidoethyl )-2-hydroxyethyl amine.

12. The composition of claim 9 wherein said organic acid is citric acid.

13. A method of softening fabrics and removing unwanted mineral encrustations therefrom comprising contacting the fabrics in an aqueous bath with a softening effective amount of the fabric softener composition of claim 1.

14. A method of softening fabrics and removing unwanted mineral encrustations therefrom comprising contacting the fabrics in an aqueous bath with a softening effective amount of the fabric softener composition of claim 9.

* * * * *